US010549819B2

(12) United States Patent
Tingey

(10) Patent No.: US 10,549,819 B2
(45) Date of Patent: Feb. 4, 2020

(54) PACKRAFTS

(71) Applicant: ALPACKA RAFT LLC, Mancos, CO (US)

(72) Inventor: Sheri Lynn Tingey, Mancos, CO (US)

(73) Assignee: ALPACKA RAFT LLC, Mancos, CO (US)

( * ) Notice: Subject to any disclaimer, the term of this patent is extended or adjusted under 35 U.S.C. 154(b) by 0 days.

(21) Appl. No.: 15/455,066

(22) Filed: Mar. 9, 2017

(65) Prior Publication Data

US 2018/0257744 A1 Sep. 13, 2018

(51) Int. Cl.
*B63B 7/08* (2006.01)

(52) U.S. Cl.
CPC ..... *B63B 7/08* (2013.01); *B63B 7/085* (2013.01)

(58) Field of Classification Search
CPC ..... B63B 7/08; B63B 7/085; B63B 2231/40
See application file for complete search history.

(56) References Cited

U.S. PATENT DOCUMENTS 2,370,069 A * 2/1945 Patten ..... B63B 7/08 114/345
4,472,225 A * 9/1984 Bimpson ..... B63B 7/08 156/198
6,065,421 A * 5/2000 Haller ..... B63B 7/08 114/345
2006/0075955 A1* 4/2006 DeChant ..... B63B 7/085 114/345

OTHER PUBLICATIONS

The Alpacka Raft—The One and Only, http://www.alpackaraft.com/product/alpacka-series, downloaded Aug. 8, 2017.
NRS Outlaw 130 Self-Bailing Rafts, https://www.nrs.com/product/86038.01/nrs-outlaw-130-self-bailing-rafts, downloaded Aug. 8, 2017.

* cited by examiner

*Primary Examiner* — Anthony D Wiest
(74) *Attorney, Agent, or Firm* — Leber IP Law; Celia H. Leber

(57) ABSTRACT

Packrafts are disclosed that include an inflatable, tubular packraft body having a bow, a stern, and a midsection, and a floor portion joined to the packraft body to define a central seating area. In these packrafts, the stern comprises a center panel joined to a pair of side panels such that the stern has a generally frustoconical shape. This stern shape provides the packraft with enhanced handling characteristics, particularly in whitewater.

13 Claims, 6 Drawing Sheets

PACKRAFTS

BACKGROUND

Packrafts are small, inflatable watercraft that can be rolled or folded up and readily carried by a user, for example, in or attached to a backpack or on a bike rack, and/or transported in a small space such as a private plane or car.

Some packrafts are designed for whitewater use, where stability and maneuverability are important characteristics. An example of a packraft suitable for use in whitewater is shown in FIG. 1. Packraft 10 includes an inflatable tubular body 11 that includes a bow 12, a midsection 14, and an extended stern 16. The raft also includes a floor 17 that defines an open area where a paddler is seated. The floor is not inflatable, and is generally in the form of a planar sheet of material. Extended stern 16 extends further rearward of the midsection to balance the weight of the paddler, who would generally be seated rear of the midsection, at location S. Balancing the paddler's weight is an important consideration in these small, lightweight rafts—unlike large, heavy conventional whitewater rafts, which weigh upwards of 100-150 pounds, making the paddlers weight of secondary importance to the balance of the craft.

The stern has a generally conical shape with a center seam 18 dividing two panels 20, 22. In some implementations, the stern includes a zipper 24, providing access to storage inside the stern (accessible when the raft is deflated.) When the packraft 10 is inflated, the zipper 24 is positioned on a twist curve (the long axis of the zipper is twisted by the curvature of the inflated conical stern.)

SUMMARY

The present disclosure features packrafts that exhibit enhanced handling characteristics.

In one aspect, the disclosure features a packraft that includes (a) an inflatable, tubular packraft body having a bow, a stern, and a midsection, and (b) a floor portion joined to the packraft body to define a central seating area; wherein the stern comprises a center panel joined to a pair of side panels such that the stern, when inflated, has a generally frustoconical shape.

Some implementations may include one or more of the following features.

The center panel may appear to be generally rectangular when the packraft is inflated. The center panel may extend the full length of the stern. The center panel may impart a substantially continuous curvature to the stern when viewed from the rear of the packraft.

In some cases, the center panel has an average width of from about 10 to 25 cm, and a length of about 60 to 100 cm.

The seating area may be configured so that a user would be seated adjacent the stern, e.g., within 1-10 inches from the forward edge of the stern.

In some implementations, the packraft further comprises an airtight zipper disposed on the center panel. The zipper may be positioned so that when the packraft is inflated the zipper is on a substantially flat area of the stern, e.g., so that it is generally colinear with a longitudinal axis of the center panel.

The floor may be non-inflatable, e.g., the floor may be generally flat when the packraft is inflated.

The length of the stern may be, for example, about 20 to 40 percent of the total length of the packraft.

In another aspect, the disclosure features a packraft that includes (a) an inflatable, tubular packraft body having a bow, a stern, and a midsection, and (b) a floor portion joined to the packraft body to define a central seating area; wherein the stern comprises a center panel that appears generally rectangular when the raft is inflated but long edges of which includes multiple curves when the center panel is laid flat.

Implementations of this aspect of the disclosure may include any one or more of the features discussed above.

DETAILED DESCRIPTION

Figure 1:
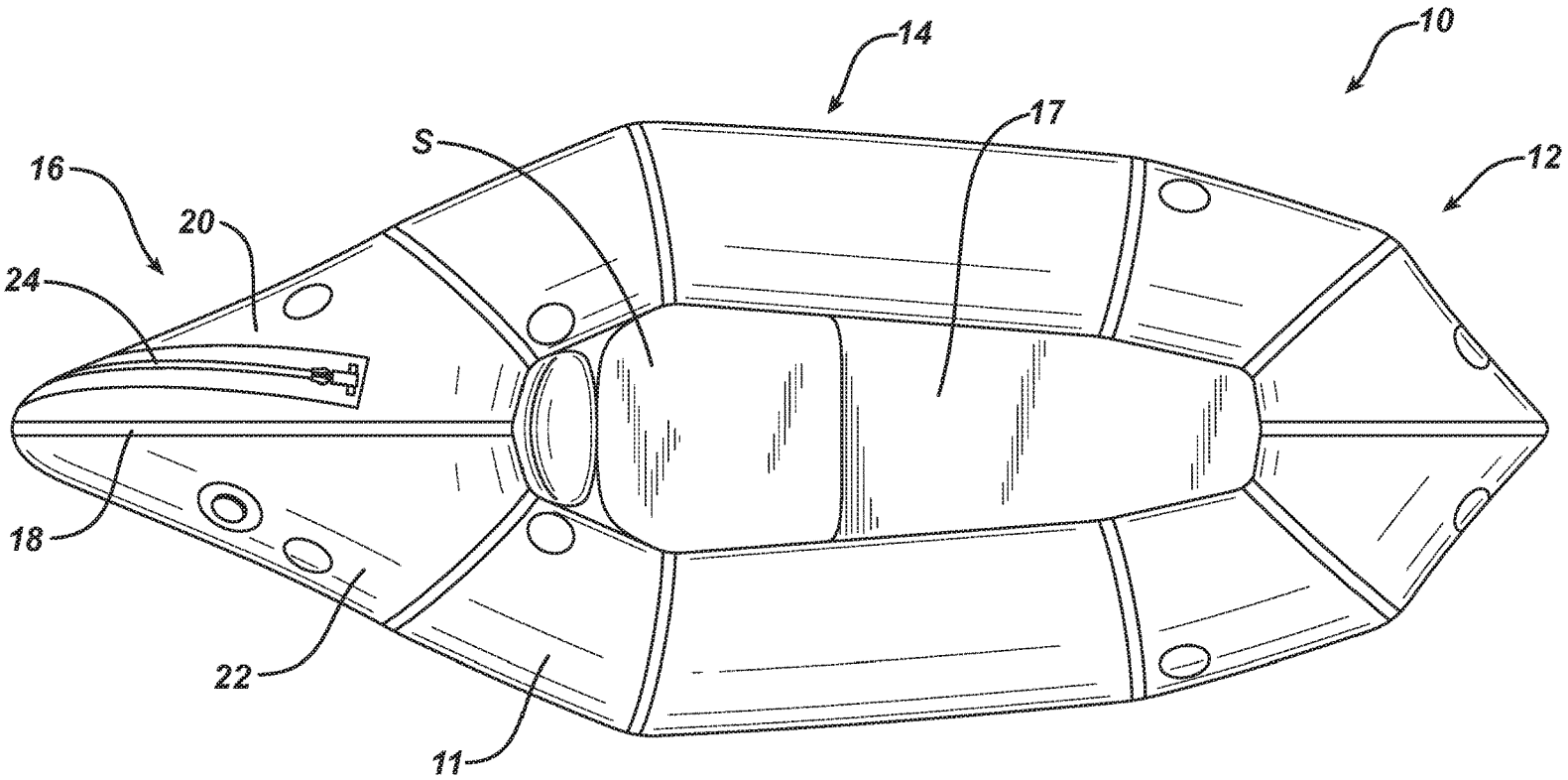
FIG. 1 PRIOR ART
FIG. 1 is a top view of a prior art packraft.
Figure 2:
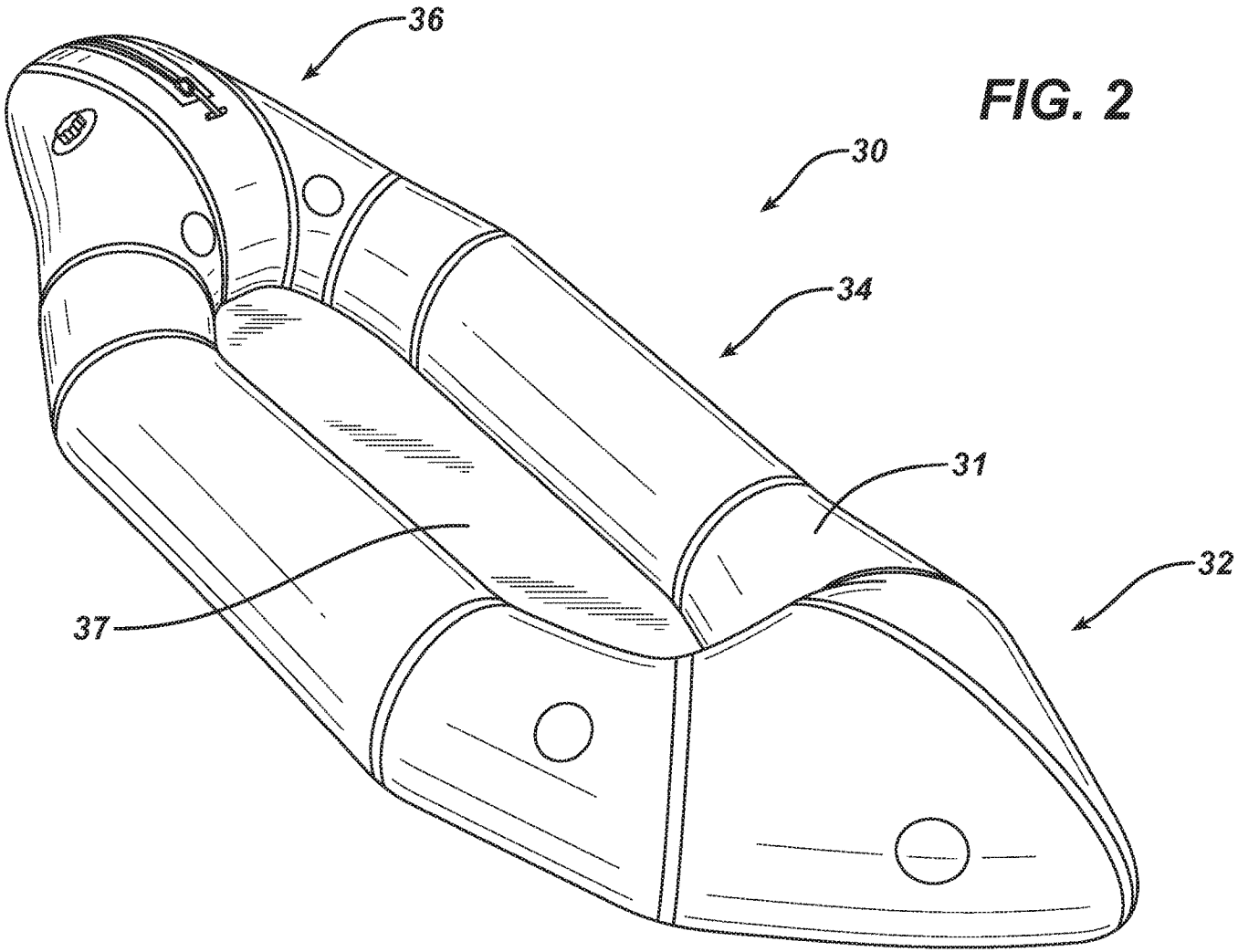
FIG. 2 is a perspective view of a packraft according to one implementation.
Figure 3:
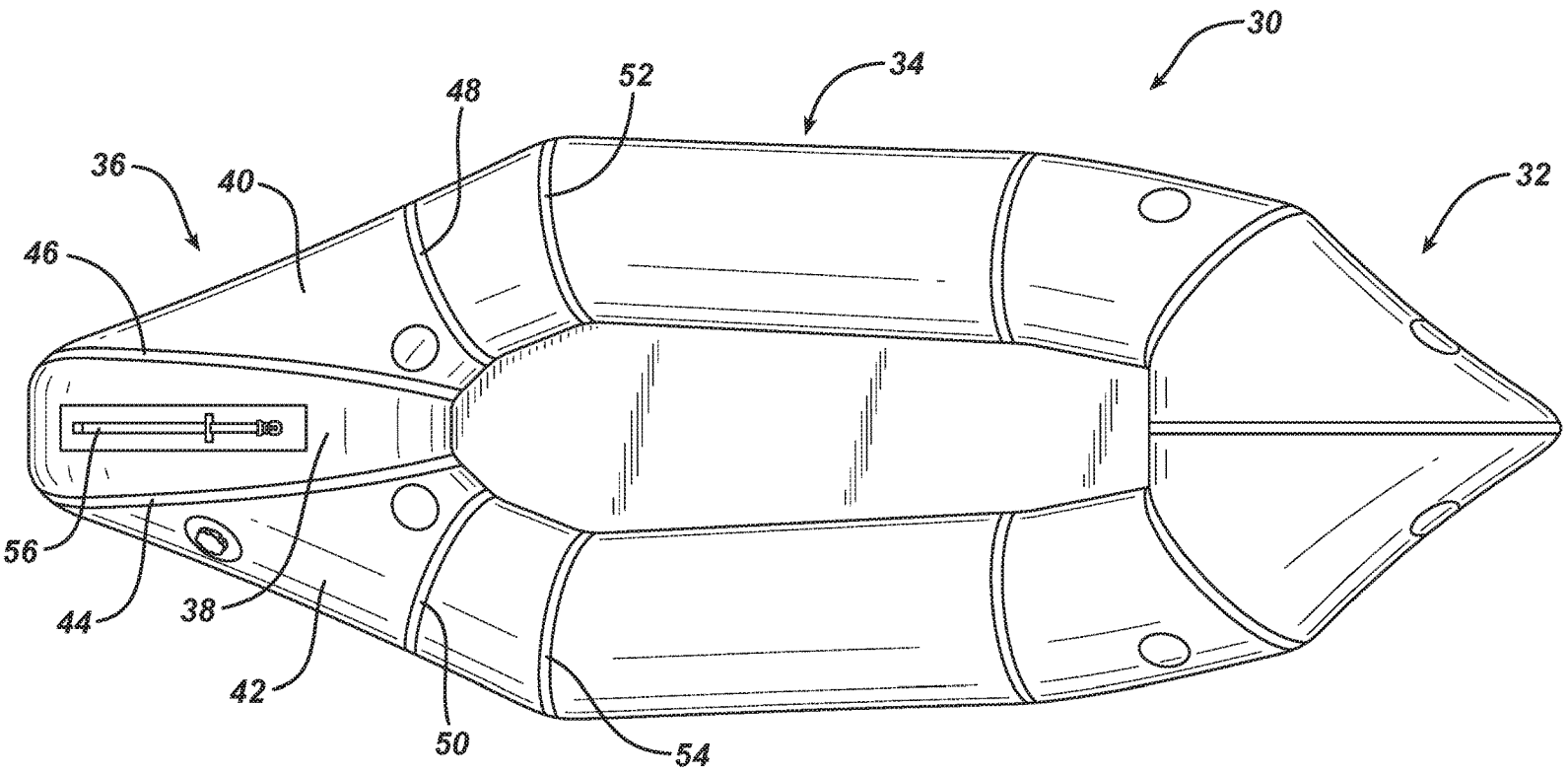
FIG. 3 is a top view of the packraft of FIG. 2.
Figure 4:
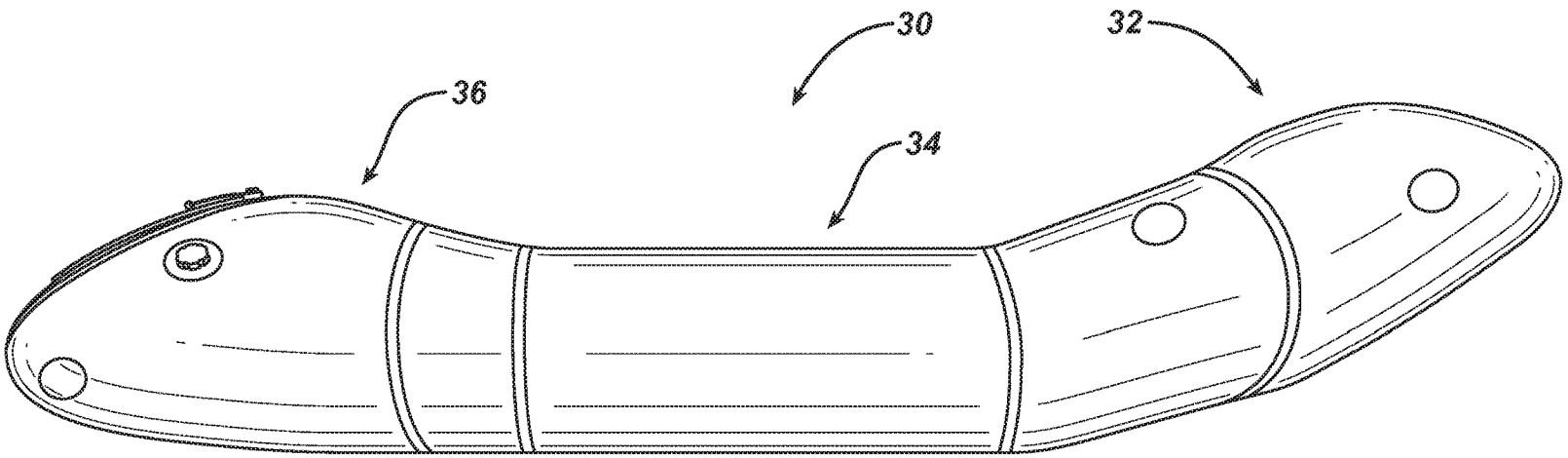
FIG. 4 is a side view of the packraft of FIG. 2.

Referring to FIGS. 2-4, packraft 30 has an inflatable tubular body 31 that includes a bow 32, a midsection 34, and a stern 36, and a floor 37. The floor 37, bow 32 and midsection 34 are similar to those of the prior art packraft 10 shown in FIG. 1.

As is the case in packraft 10, in packraft 30 the floor is sized such that a paddler would normally be seated adjacent the stern, with his or her legs extended along the length of the floor towards the bow. In some implementations, the length of the floor, from the forward edge of the stern to the rearward edge of the bow, is from about 100 cm to 160 cm. In some implementations, the packraft may be designed to accommodate two paddlers, in which case one will be seated immediately adjacent the stern and the other (generally a smaller paddler) will be seated closer to the bow.

As best seen in FIG. 3, the stern 36 of packraft 30 differs from the stern 16 of packraft 10, discussed above, in that it includes a center panel 38, joined to two side panels 40, 42, by a pair of seams 44, 46. Side panels 40, 42, may terminate at forward seams 48, 50, as shown, or the forward seams may be omitted such that the side panels extend continuously to mid-seams 52, 54, if desired.

Figure 6:
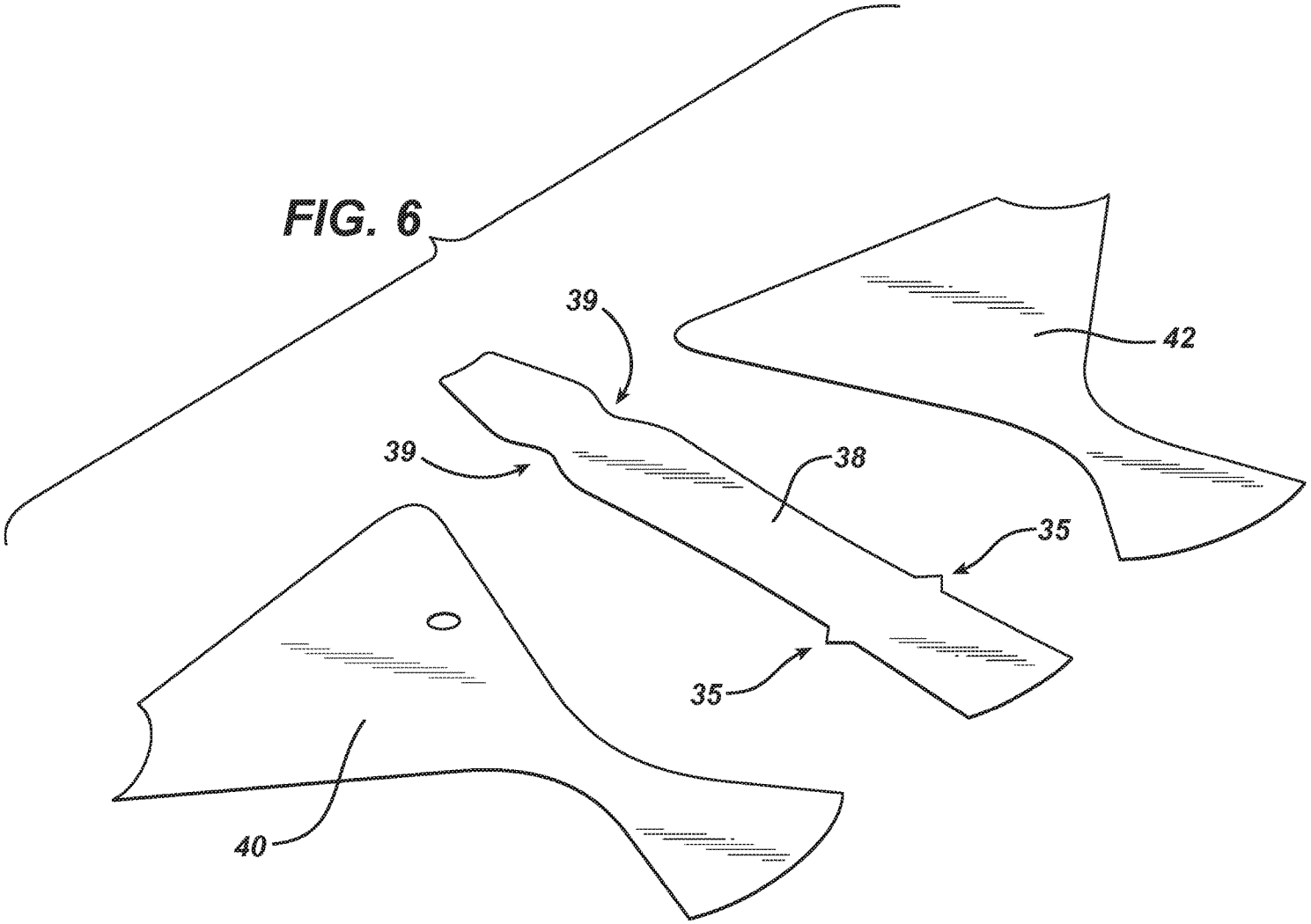
FIG. 6 is an exploded view showing the center panel and side panels of a stern according to one implementation, prior to assembly of the panels into a packraft.

The center panel is shaped such that, when the raft is inflated, the center panel 38 is generally even in width. As shown in FIG. 6, prior to inflation the center panel 38 is an elongated strip of material having a pair of small protruding areas 35 that are closer to the seating area and a pair of small concave curves 39 that are further from the seating area, with the paired features being positioned opposite to each other across the width of the center panel. These features are positioned so that the edges of center panel 38 will appear generally straight and the panel will be generally flat across its width upon inflation of the assembled raft. Other edge geometries may be used, depending on the desired three dimensional shape of the assembled, inflated raft, but it is generally preferred that the shape be selected so that the center panel is substantially flat across its width when the raft is inflated.

The center panel is preferably relatively narrow, but of a sufficient width to give the stern a frustoconical (truncated cone) shape, rather than the pointed conical shape of the prior art stern. The dimensions of the center panel will vary depending on the size and overall design of the packraft, but in some implementations the average width of the center panel will be from about 10 to 25 cm, e.g., from about 15 to 20 cm, or in some cases from about 20 to 25 cm.

The length of the center panel 38 in the assembled, inflated packraft will generally correspond to the length of the stern, as the center panel preferably runs the entire length of the stern. (The panel of fabric used to make the center panel is generally considerably longer than the center panel lengths given below, which are for the center panel in the assembled packraft.) The stern length (and thus the center panel length) will vary depending on the overall design of the packraft, but in some implementations will be from about 50 to 100 cm, e.g., from about 60 to 85 cm. In some implementations, the length of the stern is about 20 to 40 percent of the total length of the packraft, e.g., about 20 to 30 percent. As noted above, the extended length of the stern helps to balance the weight of the paddler, who is seated closer to the stern than the bow.

In addition to changing the profile of the rear edge of the stern, including the center panel 38 provides the stern with more overall volume, and makes the curve of the top surface of the stern more continuous and smooth. In some implementations, the air volume of the stern is increased by up to 30%, for example, by at least 10%, 20%, or even 25% or more over a stern that has the same dimensions except for the inclusion of the center panel.

Together, these changes to the configuration of the stern significantly improve the performance of the packraft over the prior art stern configuration, particularly in whitewater or other challenging paddling conditions such as high winds and choppy water. In particular, the stern shape provided by center panel 38 causes the packraft to exhibit good "forgiveness," predictable handling and stability in high volume whitewater. These characteristics manifest themselves, for example, in the packraft being more stable turning out of eddies, and transitioning continuously and smoothly across current lines and eddy lines. The stern shape is also significantly more stable when paddling over waves, as it keeps the boat from tipping backwards and sideways when clearing a lateral wave. Moreover, the increased air volume of the stern increases flotation of the stern, allowing the raft to ride up over waves and holes.

The larger overall volume of the stern also provides more room for storage, if the zipper 56 is provided to allow for internal stowage of gear. The increased flotation provided by the greater air volume also allows heavier gear to be stored without sacrificing the ability of the raft to ride sufficiently high in the water.

The center panel 38 also provides a flat area for positioning of the zipper 56, which in preferred implementations extends generally parallel to the length of the center panel, and may be positioned approximately colinear with the longitudinal axis of the center panel as shown. Positioning the zipper on a substantially flat area of the inflated raft is advantageous because it reduces the strain on the zipper that is imposed by the twist curve of the prior art stern, increasing the duty life of the zipper and making it easier to open and close. The flat position of the zipper also improves air retention of the airtight zipper.

The packrafts may be made of various materials that provide the desired raft characteristics. In some implementations, the packrafts are formed of lightweight, puncture resistant fabrics that exhibit little or no stretch. Some fabrics are urethane coated on one or both sides. In other implementations the fabric is formed of a spun polymer.

While the center panel and enhanced stern configuration can be used in any desired type of inflatable watercraft, they are particularly useful in lightweight inflatable packrafts. In some implementations, the packrafts described herein weigh less than 10 kg, e.g., less than 7 kg, less than 5 kg, or even less than 3 kg. In some implementations, the raft weight is from about 1 kg to 10 kg, e.g., from about 1 kg to 6.5 kg.

Other embodiments are within the scope of the following claims.

Figure 5:
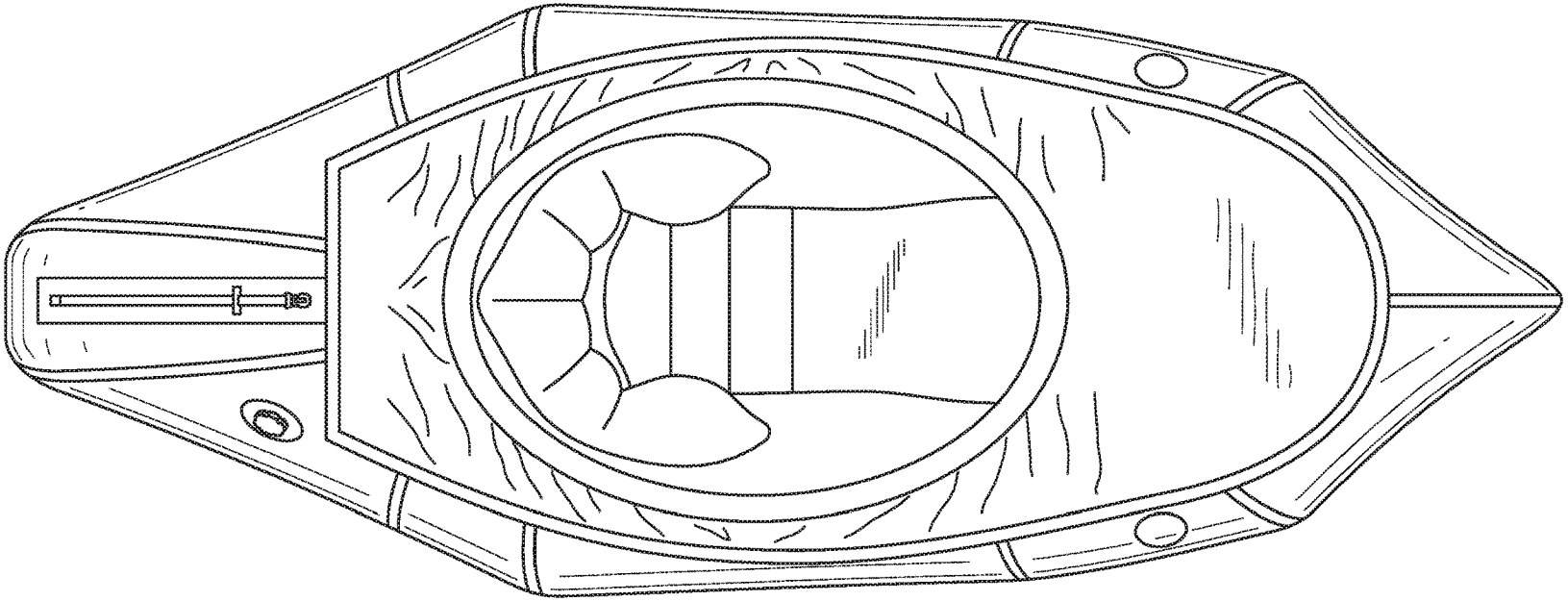
FIG. 5 is a top view of a packraft according to an alternate implementation.

For example, the packraft may have any desired bow configuration. As but one example, another implementation is shown in FIG. 5, in which the bow is wider and less conical than in the implementation shown in FIGS. 2-4. The bow will generally be shaped to suit the type of water for which the packraft is intended—longer and narrower for flatter water, wider and fatter for more challenging whitewater—and to balance the stern. The stern configuration discussed above can be used with a wider variety of bow designs and will provide generally the same functionality across many bow designs.

As another example, the zipper is an optional feature, and may be omitted from the stern of the packraft.

The center panel can be used with various side tube diameters, for example a 12 or 14 inch diameter for stability in whitewater, or a 10 inch diameter to provide more maneuverability and enhanced carving performance.

What is claimed is:

1. A packraft comprising:

an inflatable, tubular packraft body having a bow, a stern, and a midsection, and a floor portion joined to the packraft body to define a central seating area;

wherein the stern comprises a center panel joined to a pair of side panels by a pair of seams, such that the stern, when inflated, has a generally frustoconical shape, and wherein the length of the stern is more than 20 percent of the total length of the packraft;

wherein the center panel appears to be generally rectangular when the packraft is inflated and the center panel is viewed in plan view from above, and the center panel extends the full length of the stern; and;

wherein the frustoconical (truncated cone) stern is configured such that the truncated end of the cone is positioned at a distal end of the stern.

2. The packraft of claim 1 wherein the center panel has an average width of from about 10 to 25 cm.

3. The packraft of claim 1 wherein the center panel in the assembled, inflated packraft has a length of about 60 to 100 cm.

4. The packraft of claim 1 wherein the packraft has a weight of less than about 10 kg.

5. The packraft of claim 1 wherein the seating area is configured so that a user would be seated adjacent the stern.

6. The packraft of claim 1 wherein the packraft further comprises an airtight zipper disposed on the center panel.

7. The packraft of claim 6 wherein the zipper is positioned so that when the packraft is inflated the zipper is on a substantially flat area of the stern.

8. The packraft of claim 6 wherein the zipper is positioned so that it is generally colinear with a longitudinal axis of the center panel.

9. The packraft of claim 1 wherein the floor is not inflatable.

10. The packraft of claim 1 wherein the floor is generally flat when the packraft is inflated.

11. The packraft of claim 1 wherein the length of the stern is about 20 to 40 percent of the total length of the packraft.

12. The packraft of claim 1 wherein the midsection of the body is formed of tubes that, when inflated, have a tube diameter, and the length of the stern is greater than the tube diameter.

13. The packraft of claim 1 wherein in the assembled, inflated packraft the center panel has an average width of from about 10 to 25 cm and a length of about 60 to 100 cm.

* * * * *